United States Patent [19]

Scalise

[11] Patent Number: 4,729,591

[45] Date of Patent: Mar. 8, 1988

[54] COMBINATION SKI, SKI POLE AND SKI BOOT CARRYING STRAP

[76] Inventor: Ronald J. Scalise, Box 304, Pine Grove Rd., Herkimer, N.Y. 13350

[21] Appl. No.: 875,695

[22] Filed: Jun. 18, 1986

[51] Int. Cl.[4] ..... A63C 11/02

[52] U.S. Cl. ..... 294/141; 224/151; 224/917; 280/814; 294/147

[58] Field of Search ..... 280/814; 294/141, 147, 294/142, 146, 162, 159, 166, 150, 149, 152; 224/917, 151, 250; 24/302, 309, 182

[56] References Cited

U.S. PATENT DOCUMENTS

| | | | |
|---|---|---|---|
| 2,379,128 | 6/1945 | Wilson | 24/309 |
| 2,530,695 | 11/1950 | Helmert | 224/917 |
| 3,259,284 | 7/1966 | Olson | 294/166 |
| 3,960,302 | 1/1976 | Mazzoni | 294/147 |
| 3,976,234 | 8/1976 | Moudry et al. | 24/302 |
| 4,242,813 | 1/1981 | Quance | 294/159 |
| 4,244,498 | 1/1981 | Copp | 294/162 |
| 4,463,885 | 8/1984 | Ball et al. | 294/147 |
| 4,488,748 | 12/1984 | Burkes | 294/147 |
| 4,518,107 | 5/1985 | Amos | 224/917 |
| 4,537,436 | 8/1985 | Pfortmiller | 294/150 |

*Primary Examiner*—David M. Mitchell

*Attorney, Agent, or Firm*—Fleit, Jacobson, Cohn & Price

[57] ABSTRACT

A convertible carrier for skis and ski boots is in the form of a strap with a pair of buckles for forming adjustable size loops at opposite ends of the strap connected by a central portion of the strap forming a handle. The loops can be tightened around a pair of back-to-back skis in spaced positions along the length of the skis so that the skis are slung from the central portion of the carrier. Alternatively, the loops can be tightened around respective ski boots and fastened together by a suitable fastener which is provided with the strap so as to form a convenient carrier for the boots.

5 Claims, 5 Drawing Figures

FIG. 1
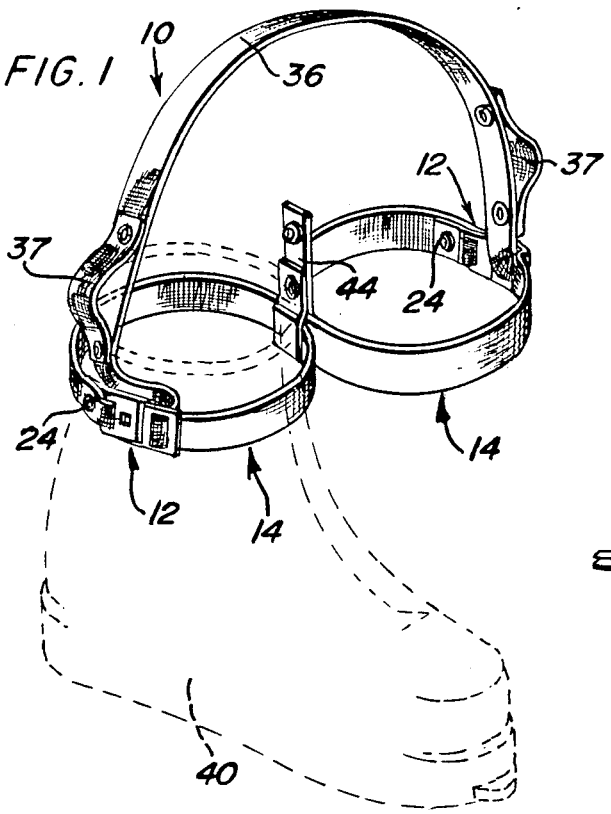
FIG. 2
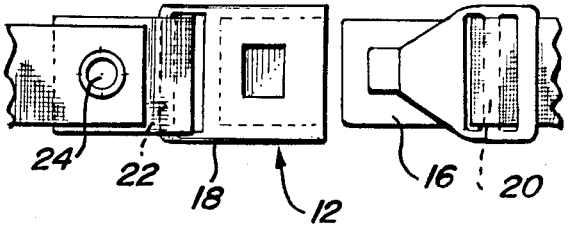
FIG. 3
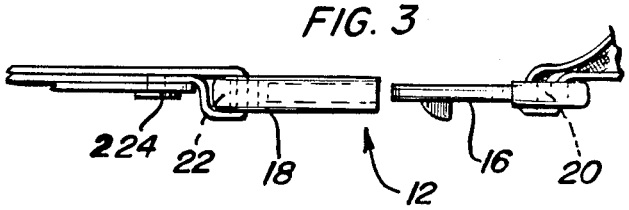
FIG. 4
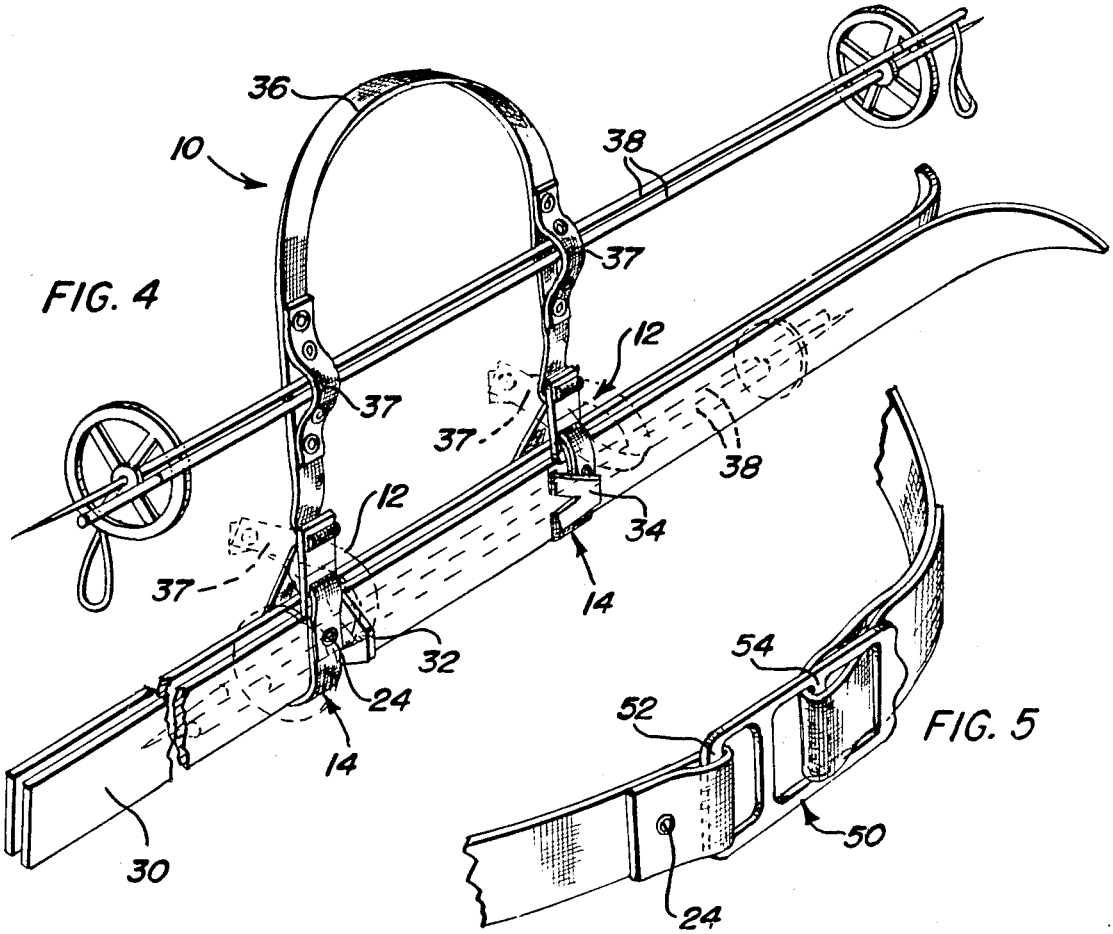
FIG. 5

COMBINATION SKI, SKI POLE AND SKI BOOT CARRYING STRAP

BACKGROUND AND SUMMARY OF THE INVENTION

This invention relates to a carrying strap which can be used selectively to carry a pair of ski boots, or a pair of back-to-back skis as well as associated ski poles.

In accordance with the invention, there is provided a novel form of carrying strap which can be converted as between the above stated uses in a simple manner thereby providing a useful adjunct for a skier. Further, the carrying strap is simple and economical to manufacture being made from readily available components.

A convertible carrier for skis and ski boots in accordance with the invention comprises a strap with a pair of buckles for forming adjustable size loops at opposite ends of the strap connected by a central portion of the strap forming a handle, the loops being adapted for tightening around a pair of back-to-back skis in spaced relation along the length of the skis, whereby the skis are slung from the central portion of the carrier, and the carrier further including fastener means for releasably connecting the loops together for use of the carrier in carrying a pair of boots with the loops tightened around the respective boots. The strap may, for example, be made from standard 1-inch non-stretch nylon webbing and the buckles may also be standard-type buckles of plastic or metal with pairs of crossbars around which the strap is looped and fixed at its respective ends. The buckles may be solid one-piece buckles or may be a known type of snap-together buckles. The fastener means for connecting the respective end loops of the strap together when used for carrying ski boots may comprise respective snaps sewn to respective portions of the belt or alternatively the fastener means may comprise a strip of webbing for encircling portions of the respective loops with snap fasteners being provided on the strip.

The invention thus provides a readily convertible novel form of carrier for skis or ski boots which is extremely simple to convert as between its respective uses simply by adjusting the lengths of the respective loops and securing or releasing the fastener means as required.

The following U.S. patents disclose a variety of strap-type carriers for skis, boots and the like. None of these patents, however, shows a convertible carrier for skis and boots comprising a strap with buckles forming adjustable end loops used separately when the strap is configured as a ski carrier but which can be connected together by a fastener or the like when the strap is to be used as a boot carrier, as with the present invention.

U.S. Pat. No. 2,679,937, June 1, 1954
U.S. Pat. No. 3,587,951, June 28, 1971
U.S. Pat. No. 3,653,565, Apr. 4, 1972
U.S. Pat. No. 3,841,542, Oct. 15, 1974
U.S. Pat. No. 3,960,302, June 1, 1976
U.S. Pat. No. 4,261,493, Apr. 14, 1981
U.S. Pat. No. 4,463,885, Aug. 7, 1984.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a carrying strap in accordance with the invention shown as configured for carrying a pair of ski boots.

FIG. 2 is a plan view of one form of buckle used in the strap.

FIG. 3 is an elevational view of the buckle.

FIG. 4 is a perspective view of the strap configured for carrying a pair of back-to-back skis and ski poles.

FIG. 5 is a perspective view of an alternate form of buckle for the strap.

DESCRIPTION OF THE PREFERRED EMBODIMENT

A convertible carrier in accordance with the invention for skis and ski boots comprises a strap 10 which conveniently may be a standard 1-inch non-stretch nylon webbing strap, and a pair of buckles 12 for forming adjustable size loops 14 at opposite ends of the strap.

As shown in FIGS. 2 and 3, each buckle 12 may comprise snap together plastic male and female sections 16 and 18, of known form, provided with respective crossbars 20, 22. To form the loops 14 at opposite ends of the strap, the strap end is first looped over crossbar 20, and then over crossbar 22. The free end of the strap may then be secured adjacent crossbar 22, for example, by a rivet 24 or the like. It is to be understood that both loops 14 are formed in the same way.

The above arrangement of loops 14 allows the respective loops to be enlarged or decreased in size by moving the strap through the male buckle member 16 over crossbar 20. Also, the loops can be completely opened by detaching the male and female buckle sections.

Thus, the respective loops 14 may, for example, be tightened around a pair of back-to-back skis 30, FIG. 4, at positions adjacent the respective heel and toe bindings 32, 34 of the skis. The loops may be tightened by pulling on the connecting portion 36 of the strap between the loops which forms a handle from which the skis are then slung. The strap may also be provided with snap on strips of similar webbing 37 which form supports for a pair of ski poles 38.

For conversion of the carrier for use with a pair of ski boots, such as boot 40 in FIG. 1, the respective loops 14 are enlarged as compared with the size that they were for carrying skis so that the loops can be fitted around the tops of the respective boots. Also, for this use of the carrier, the loops 14 are preferably connected together by a snap together strip of webbing 44 which is encircled around portions of the respective loops and fastened together. Strip 44 could be replaced by respective snaps on the straps themselves or one of the strips 37 could be used for this purpose.

An alternative form of buckle 50, for use in place of buckles 14 is shown in FIG. 5. This is a well known form of one-piece buckle having crossbars 52 and 54 conforming with the crossbars 22 and 20 of the first embodiment. This buckle is used in the same way as the previous one, but with this buckle the respective loops 14 of the strap cannot be opened.

It will be evident from the foregoing that the invention provides an extremely simple and economical form of carrier which can be selectively used for the stated purposes or for other like purposes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A convertible carrier for skis and ski boots comprising a strap with a pair of buckles for forming adjustable size loops at opposite ends of the strap connected by a central portion of the strap forming a handle, the loops being adapted for tightening around a pair of back-to-back skis in spaced relation along the length of the skis whereby the skis are slung from the central portion of the carrier, and the carrier further including fastener means for releasably connecting the loops together for use of the carrier in carrying a pair of boots with the loops tightened around the respective boots, said fastener means comprising a clip member for releasable encircling attachment around parts of the strap defining the respective loops.

2. The invention of claim 1 wherein each buckle comprises a first part to which a respective end of the strap is secured and a second part with a bar through which the strap is wound to form the respective loop, said respective parts of each buckle being separable.

3. The invention of claim 3 wherein the carrier includes a pair of clips on the strap for carrying ski poles therebetween.

4. The invention of claim 3 including releasable clips for releasable attachment to the strap at spaced locations therealong between the loops for carrying ski poles therebetween.

5. The invention of claim 4 wherein the clips each comprise a length of strapping and snap fastener means for releasably securing opposite ends of the strapping to the strap with a ski pole therebetween.

* * * * *